US005807068A

United States Patent [19]

Dobler et al.

[11] Patent Number: 5,807,068

[45] Date of Patent: Sep. 15, 1998

[54] FLOW PUMP FOR FEEDING FUEL FROM A SUPPLY CONTAINER TO INTERNAL COMBUSTION ENGINE OF A MOTOR VEHICLE

[75] Inventors: Klaus Dobler; Michael Huebel, both of Gerlingen; Willi Strohl, Beilstein; Jochen Rose, Hemmingen; Bernhard Blaettel, Weil Im Schoenbuch, all of Germany

[73] Assignee: Robert Bosch GmbH, Stuttgart, Germany

[21] Appl. No.: 700,504

[22] PCT Filed: Jan. 10, 1996

[86] PCT No.: PCT/DE96/00024

§ 371 Date: Aug. 21, 1996

§ 102(e) Date: Aug. 21, 1996

[87] PCT Pub. No.: WO96/24769

PCT Pub. Date: Aug. 15, 1996

[30] Foreign Application Priority Data

Feb. 8, 1995 [DE] Germany ..... 195 04 079.1

[51] Int. Cl.[6] ..... F04D 5/00

[52] U.S. Cl. ..... 415/55.1

[58] Field of Search ..... 415/55.1, 55.2, 415/55.3, 55.4, 55.5, 55.6, 55.7

[56] References Cited

U.S. PATENT DOCUMENTS

| | | | |
|---|---|---|---|
| 1,689,579 | 10/1928 | Burks . | |
| 1,973,669 | 9/1934 | Spoor . | |
| 2,042,499 | 6/1936 | Brady | 415/55.4 |
| 3,095,820 | 7/1963 | Sanborn et al. | 415/55.7 |
| 3,917,431 | 11/1975 | Rose | 415/55.6 |
| 3,951,567 | 4/1976 | Rohs | 415/55.2 |
| 4,653,979 | 3/1987 | Schillinger | 415/55.6 |
| 5,265,996 | 11/1993 | Westhoff et al. | 415/55.1 |

FOREIGN PATENT DOCUMENTS

| | | | |
|---|---|---|---|
| 1403575 | 11/1968 | Germany . | |
| 3327922 | 2/1985 | Germany . | |
| 0578497 | 10/1997 | U.S.S.R. | 415/55.1 |
| 9200457 | 1/1992 | WIPO . | |

*Primary Examiner*—Christopher Verdier
*Attorney, Agent, or Firm*—Michael J. Striker

[57] ABSTRACT

The flow pump has an impeller (22), revolving in a pump chamber, which on each of its two axially oriented face ends (28, 29), has one ring of vanes (30) between which interstices (31) are located, and which cooperates with a feed channel (34) associated with the vanes (30) for pumping the fuel. When viewed in the radial direction relative to the rotary axis (24) of the impeller (22), the vanes (30) are positioned obliquely with respect to the rotary axis (24) in such a way that they lead ahead in the circumferential direction (21) of the impeller (22) toward the face end (28, 29) of the impeller (22). The vanes (30) and the rotary axis (24) of the impeller (22) form an angle (α) of between 25° and 70° that is oriented in the circumferential direction (21) of the impeller (22). Because of this obliquely positioned arrangement of the vanes (30), an improved inflow of the pumped fuel into the interstices (31) between the vanes (30) is effected, compared with an arrangement of vanes (30) that is parallel to the rotary axis (24), and as a result an increased feed pressure and improved efficiency of the flow pump are attained.

12 Claims, 4 Drawing Sheets

FLOW PUMP FOR FEEDING FUEL FROM A SUPPLY CONTAINER TO INTERNAL COMBUSTION ENGINE OF A MOTOR VEHICLE

BACKGROUND OF THE INVENTION

The invention is based on a flow pump for feeding fuel from a supply container to the internal combustion engine of a motor vehicle.

One such flow pump is known from German Patent Disclosure DE 33 27 922 A1. This flow pump has an impeller, which has one ring of circumferentially spaced-apart vanes on each of its two axially pointing face ends, with interstices between the vanes. The vanes cooperate with an annular feed conduit for feeding fuel. The vanes are embodied as flat, and when the impeller is viewed radially to its rotary axis, the vanes extend parallel to the rotary axis of the impeller. Between the vanes and the feed conduit, a circulation flow develops, by which the energy transport from the impeller to the flow takes place. The fuel enters the interstices in the region of the radially inner ends of the vanes and emerges again from the interstices in the region of the radially outer ends. The flow undergoes a change of twist between the inlet and the outlet, and as a result a pressure increase is brought about in the annular feed conduit. When the impeller is embodied with vanes that are perpendicular to the face end, unfavorable flow conditions prevail, especially on the inflow and outflow of the pumped fuel into the spaces between the vanes or from the vanes, so that neither the feed pressure attainable with the known flow pump or its efficiency is optimal.

SUMMARY OF THE INVENTION

The flow pump of the invention has the advantage over the prior art that the attainable feed pressure and efficiency are increased. This can be ascribed to the improved flow conditions, resulting from the arrangement of the vanes in which they lead ahead in the circumferential direction of the impeller, on the face end of the impeller, since as a result of these improved conditions an inflow of the pumped fuel into the interstices that is approximately parallel to the vanes is attained. As a result, a breakaway or separation of the flow, on the back side of the vanes pointing counter to the circumferential direction of the impeller, along with the attendant turbulence, are prevented. And as a result in turn impact losses in the flow are avoided and an increase in the circulation flow, which is responsible for the energy transport between the vanes of the impeller and the feed conduit, is attained.

BRIEF DESCRIPTION OF THE DRAWINGS

A plurality of exemplary embodiments of the invention are shown in the drawings and described in the ensuing description.

DESCRIPTION OF THE EXEMPLARY EMBODIMENTS

Figure 1:
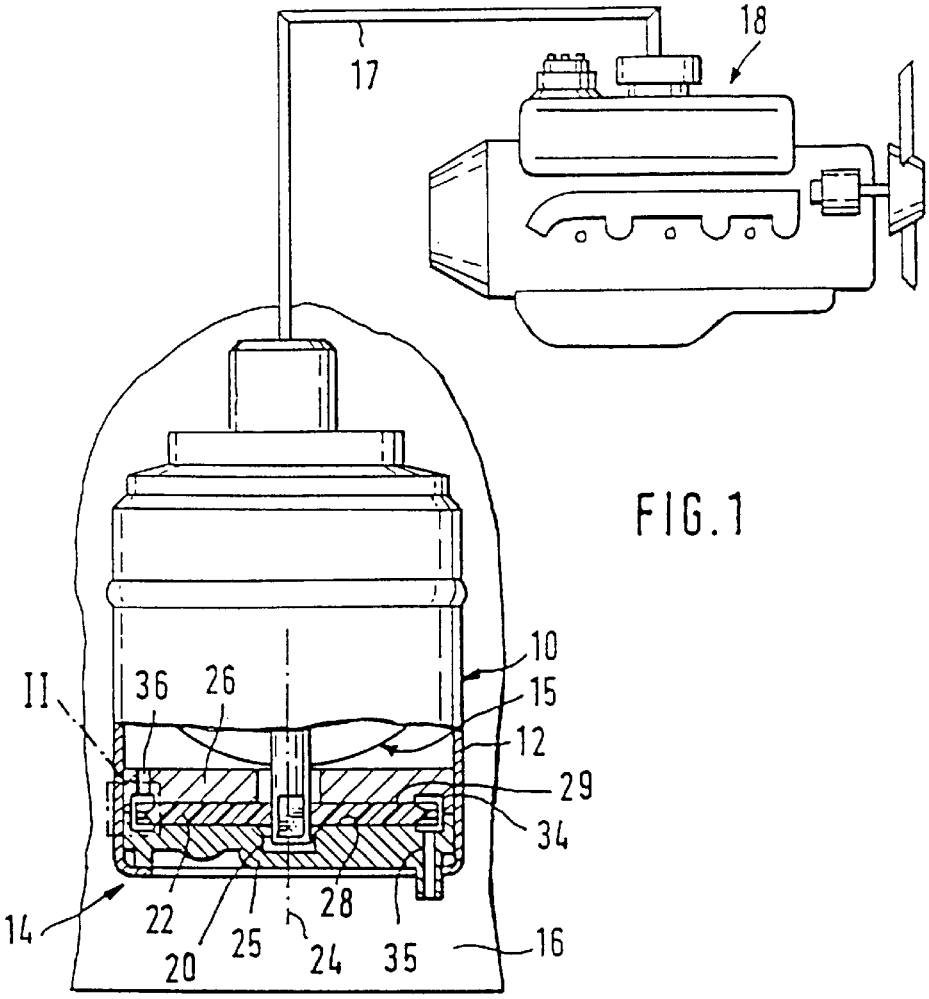
FIG. 1 shows a partial sectional views a flow pump for feeding fuel from a supply container to the internal combustion engine of a motor vehicle, in a simplified illustration.

FIG. 1, in a simplified illustration, shows an assembly 10, which in a common housing 12 includes a flow pump 14 and a drive motor 15 for the flow pump 14. The assembly 10 is disposed in a fuel supply container 16 of a motor vehicle, and the flow pump 14 aspirates fuel, during operation of the assembly 10, from the supply container 16 and feeds it via a pressure line 17 to the internal combustion engine 18 of the motor vehicle. The flow pump 14 has an impeller 22, revolving in a pump chamber 20; the pump chamber 20 is defined in the direction of the rotary axis 24 of the impeller 22 by one chamber wall 25, 26 each.

Figure 2:
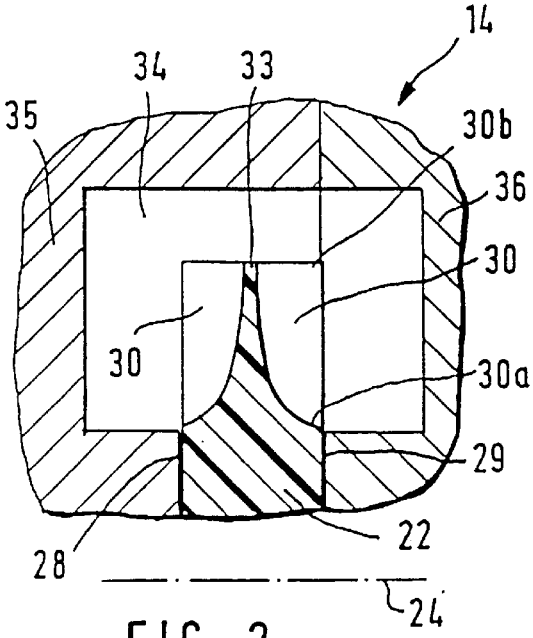
FIG. 2, in an enlarged view and in section, shows a detail marked II in FIG. 1 of the flow pump in a first exemplary embodiment.
Figure 3:
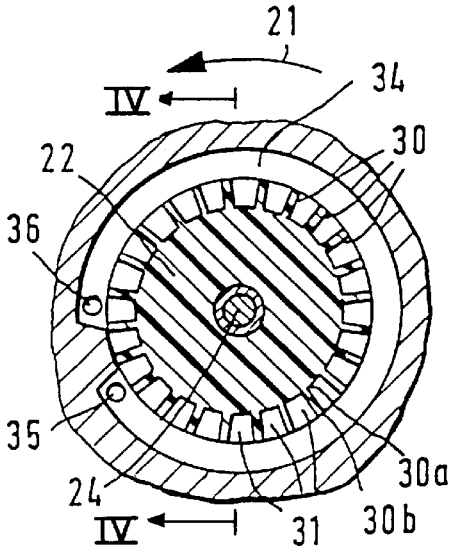
FIG. 3 shows the impeller of the flow pump of FIG. 2 in a cross section perpendicular to its rotary axis.
Figure 4:
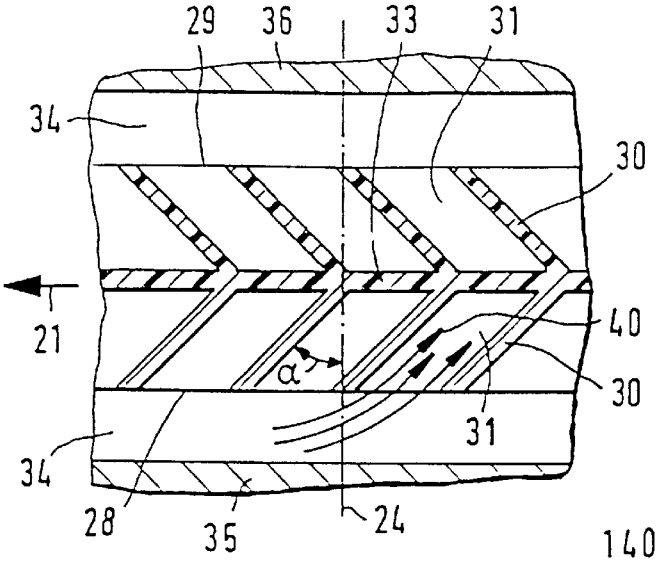
FIG. 4 shows the impeller of the flow pump in a section taken along the line IV—IV of FIG. 3.

In FIGS. 2–4, the flow pump 14 is shown in a detail in accordance with a first exemplary embodiment and is embodied as a so-called peripheral side-channel pump. The impeller 22, on each of its two axially oriented face ends 28, 29, that is, pointing in the direction of its rotary axis 24, has a ring of vanes 30 disposed in the circumferential direction of the impeller 22 and spaced apart from one another. Groovelike interstices 31 are present between the vanes 30, and the vanes 30 are embodied as essentially flat. When viewed in the longitudinal sections through the impeller 22 that include the rotary axis 24, the bottom of the groovelike interstices 31 is embodied in rounded fashion, for example being in the form of a circular segment. The vanes 30 extend radially of the rotary axis 24 of the impeller 22 from a radially inner end 30*a* to a radially outer end 30*b* on the outer circumference of the impeller 22. In the direction of the rotary axis 24 of the impeller 22, the vanes 30 extend from a rib 33, which divides the vane rings of the two face ends 28, 29 from one another approximately in the middle of the axial width of the impeller 22, to the face ends 28, 29 of the impeller 22.

The vane rings of the impeller 22 cooperate with an annular feed channel 34, formed in the pump chamber 20, for feeding fuel. An intake opening 35 discharges into the feed channel 34 at its beginning, and a pressure opening 36 discharges into it at its end. The fuel to be pumped flows through the inlet opening 35 into the feed channel 34 and flows out of the feed channel at increased pressure through the pressure opening 36. The feed channel 34 extends radially relative to the rotary axis 24 of the impeller 22, beginning at the radially inner ends 30*a* of the vanes 30 to beyond the radially outer ends 30*b* of the vanes. In the direction of the rotary axis 24 of the impeller 22, the feed channel 34 extends beyond each of the face ends 28, 29 of the impeller 22. Thus in the direction of the rotary axis 24 of the impeller 22, the feed channel 34 is located laterally beside the vanes 30, and it moreover extends beyond the outer circumference of the impeller 22.

As clearly shown in FIG. 4, the vanes 30 are positioned obliquely, such that toward the respective face end 28, 29 at which the vanes 30 end, beginning at the rib 33, they lead ahead in the circumferential direction 21 of the impeller 22. This means that the vanes 30 are not disposed parallel to the rotary axis 24 of the impeller 22, or in other words perpendicular to the respective face end 28, 29; instead, with the rotary axis 24, they form an angle α pointing in the circumferential direction 21 of the impeller 22. The angle α is between 25° and 60°, preferably between 30° and 55°. Because of this oblique positioning, the vanes 30 are disposed approximately parallel to the relative flow, represented by the arrows 40 in FIG. 4, of the fuel flowing into the interstices 31 between the vanes 30; this averts a separation of the flow and hence turbulence on the back sides of the vanes 30 pointing counter to the circumferential direction 21 of the impeller 22. As a result, so-called impact losses are eliminated and an increase in the circulation current, which is responsible for the fluid-mechanical energy transport between impeller 22 and feed channel 34, is attained. The overall result made possible when the above-described impeller 22 is used is an increase in the feed pressure and in the efficiency in the flow pump.

Figure 6:
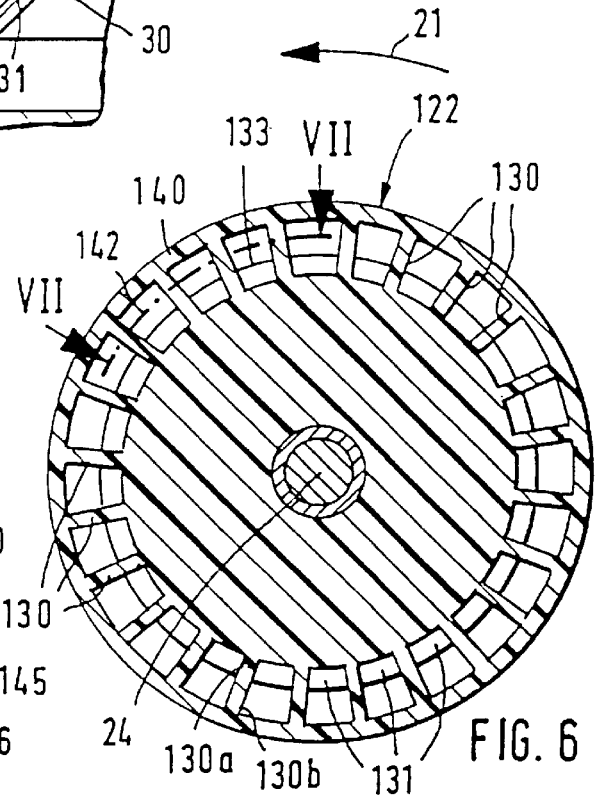
FIG. 6 shows the impeller of the flow pump of FIG. 5 in a cross section perpendicular to its rotary axis.
Figure 5:
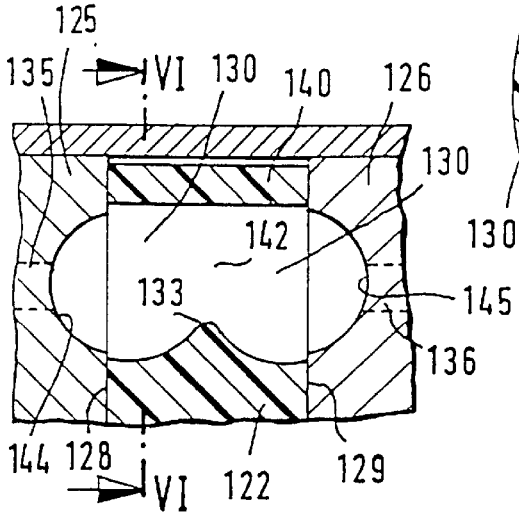
FIG. 5 shows a sectional view of the detail marked II in FIG. 1 of the flow pump in a second exemplary embodiment.
Figure 7:
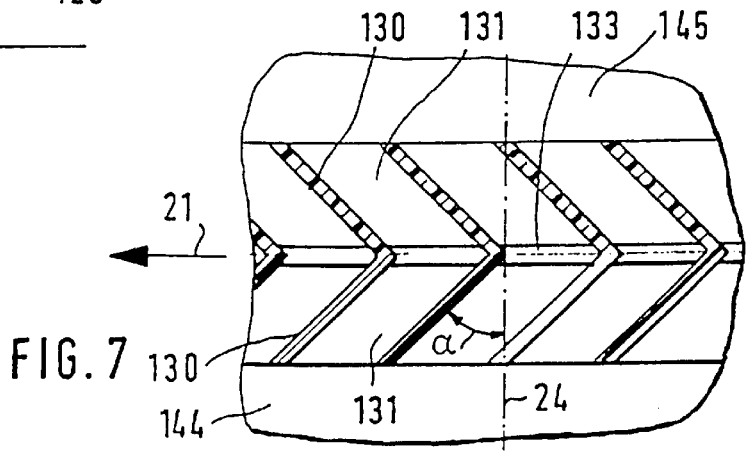
FIG. 7 shows the impeller of the flow pump in a section taken along the line VII—VII of FIG. 6.

In FIGS. 5–7, the flow pump 14 in accordance with a second exemplary embodiment is shown and embodied as a so-called side channel pump. The impeller 122 has one ring of vanes 130, spaced apart from one another in the circumferential direction of the impeller 122, on each of its two axially oriented face ends 128, 129, and there are groovelike interstices 131 between these vanes. The vanes 130 of the two face ends 128, 129 of the impeller 122 are divided from one another by a rib 133 in the direction of the rotary axis 24 of the impeller 122 and are joined together by a closed ring 140 on their radially outer ends 130*b*. The rib 133 may be embodied continuously in the radial direction with respect to the rotary axis 24 of the impeller 122, so that the two face ends 128, 129 of the impeller 122 are entirely separate from one another, or else the rib 133 may terminate radially before the ring 140, so that an opening 142 remains between the rib 133 and the ring 140 in the region of each of the interstices 131, by which opening the two face ends 128, 129 of the impeller 122 communicate with one another.

An annular feed channel 144 and 145 is embodied in each of the chamber walls 125, 126 oriented toward the respective face ends 128, 129 of the impeller 122; the feed channel 144, 145 is embodied facing the respective ring of vanes 130 in the face ends 128, 129 of the impeller 122. The intake opening 135 discharges into the one feed channel 144 at its beginning, and the pressure opening 136 discharges into the other feed channel 145, at its end. The two feed channels 144, 145 have no communication with one another via the outer circumference of the impeller 122, or in other words via the outer circumference of the ring 140. As described for the first exemplary embodiment, the vanes 130 of FIG. 7 are positioned obliquely, in such a way that beginning at the rib 133 they lead ahead in the circumferential direction 21 of the impeller 122 toward the respective face 128, 129 where the vanes 130 terminate. This means that the vanes 130 are not disposed parallel to the rotary axis 24 of the impeller 122; instead, with the rotary axis 24, they form an angle α pointing in the circumferential direction 21 of the impeller 122. The angle α is between 25° and 60°, preferably between 30° and 55°.

Figure 8:
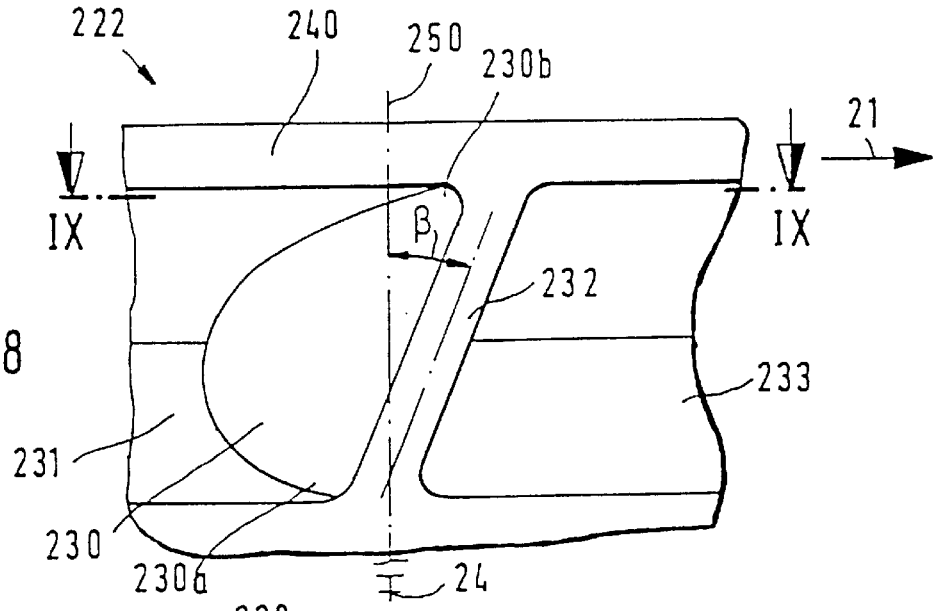
FIG. 8 shows the impeller of the flow pump in a third exemplary embodiment, in a side view in the direction of its rotary axis.
Figure 9:
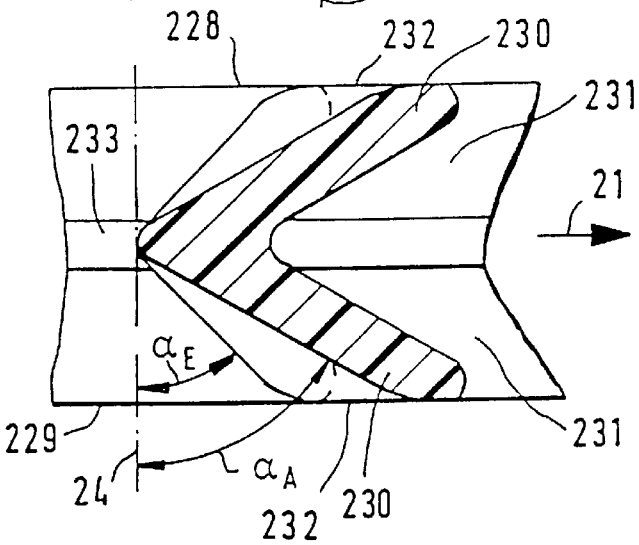
FIG. 9 shows the impeller in a section taken along the line IX—IX of FIG. 8.

In FIGS. 8 and 9, the impeller 222 of the flow pump 14 is shown in accordance with a third exemplary embodiment. As in the second exemplary embodiment, the flow pump 14 is embodied as a side channel pump, and the two feed channels visible in FIG. 5 are present; each ring of vanes of one face end of the impeller 222 cooperates with a respective feed channel. On each of its two axially oriented face ends 228, 229, the impeller 222 has a ring of vanes 230, spaced apart from one another in the circumferential direction, between which are groovelike interstices 231 whose bottom is rounded, for instance in the form of a circular segment. The vanes 230 are joined together via a ring 240 on their radially outer ends 230*b*. As viewed in the side view of the impeller 222 of FIG. 8, the edges 232 of the vanes 230, with which the vanes terminate at the respective face end 228, 229 of the impeller, are not disposed radially relative to the rotary axis 24 of the impeller 222; instead, the edges 232 lead ahead, at the radially outer ends 230*b* of the vanes 230, relative to their arrangement on the radially inner ends 230*a* of the vanes 230 in the circumferential direction 21 of the impeller 222. The edges 232 of the vanes 230 extend rectilinearly on the respective face end 228, 229 of the impeller 222, from the radially inner ends 230*a* of the vanes 230 to the radially outer ends 230*b* of the vanes 230. With respect to a line 250 laid radially relative to the rotary axis 24 of the impeller 222 through the middle of the edges 232 on the radially inner end 230*a* of the vanes 230, the edges 232 are inclined by an angle β in the circumferential direction 21 of the impeller 222. The angle β is between 20° and 45°, preferably between 25° and 40°.

In addition, as shown in FIG. 9, the vanes 230 are positioned obliquely, as in the first and second exemplary embodiments, in such a way that beginning at the rib 233 that divides the vanes 230 of the two face ends 228, 229 from one another, they lead ahead in the circumferential direction 21 of the impeller 222 toward the respective face end 228, 229 where the vanes 230 terminate. This means that the vanes 230 are not disposed parallel to the rotary axis 24 of the impeller 222 but instead, with the rotary axis 24, form an angle α oriented in the circumferential direction 21 of the impeller 222. However, over the course of the vanes 230, beginning at their radially inner end 230*a* and extending to their radially outer end 230*b*, the angle α is not constant. In the region of their radially inner ends 230*a*, the vanes 230 on the respective face end 228, 229 of the impeller 222 form with the rotary axis 24 an angle $\alpha_E$, oriented in the circumferential direction 21 of the impeller 222, which is between 25° and 50° and in particular between 30° and 45°. Preferably, the angle $\alpha_E$ is about 37°. In the region of their radially outer ends 230*b*, the vanes 230 on the respective face end 228, 229 of the impeller 222 form an angle $\alpha_A$ with the rotary axis 24, the angle being oriented in the circumferential direction 21 of the impeller 222 and being between 45° and 70° and in particular between 50° and 65°. Preferably, the angle $\alpha_A$ is about 60°. The angle α increases linearly, from the radially inner ends 230*a* of the vanes 230 to their radially outer ends 230*b*. Because of this increase in the angle α beginning at the radially inner ends 230*a* of the vanes 230 to their radially outer ends 230*b*, the above-described arrangement, inclined forward in the circumferential direction 21 of the impeller 222 by the angle β, of the edges 232 of the vanes 230 is brought about. In the region of their inner ends disposed on the rib 233, the vanes 230 extend in cross section, observed vertically to the rotary axis 24 of the impeller 222, approximately radially relative to the rotary axis 24, or in other words are not inclined as they are on their edge 232 located at the face end.

By the above-described embodiment of the vanes 230 with the angle α that increases from their radially inner ends 230*a* to their radially outer ends 230*b*, the feed pressure and efficiency of the flow pump are increased further. This is because of the further increase in the change of twist in the flow of the fuel, which enters the interstices 231 in the region of the radially inner ends 230*a* of the vanes 230 and emerges from the interstices 231 again in the region of the radially outer ends 230*b* of the vanes 230. From the inlet to the outlet, the flow of fuel undergoes an additional change in twist, which leads to a increase in the pressure and in the efficiency.

Figure 10:
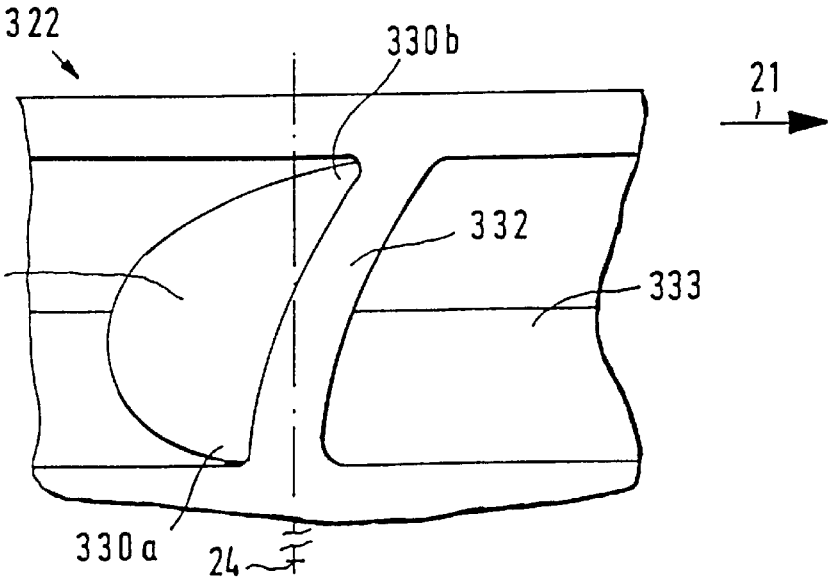
FIG. 10 shows a modified embodiment of the impeller of FIG. 8.

In FIG. 10, a variant of the impeller 322 of the flow pump of the third exemplary embodiment is shown in a side view. The impeller 322 is embodied substantially identically to the third exemplary embodiment, except that the edge 332, at which the vanes 330 terminate on the face end of the impeller 322, are not rectilinear but curved. In the region of the radially inner ends 330*a* of the vanes 330, the edge 332 is disposed approximately radially relative to the rotary axis 24 of the impeller 322, and the edge 332 extends, increasing continuously, to the radially outer ends 330*b* of the vanes 330 in the circumferential direction 21 of the impeller 322. Accordingly, the angle α that the vanes 330 form with the rotary axis 24 of the impeller 322 becomes larger from the radially inner ends 330*a* of the vanes 330 to their radially outer ends 330*b*. The increase in size of the angle α is not linear as in the third exemplary embodiment but rather increases toward the radially outer ends 330*b* of the vanes 330. In the region of their inner ends disposed on the rib 333, the vanes 330, viewed in cross section perpendicular to the rotary axis 24 of the impeller 322, extend approximately radially relative to the rotary axis 24, and accordingly are not curved as on their edge 332 located at the face end.

Figure 11:
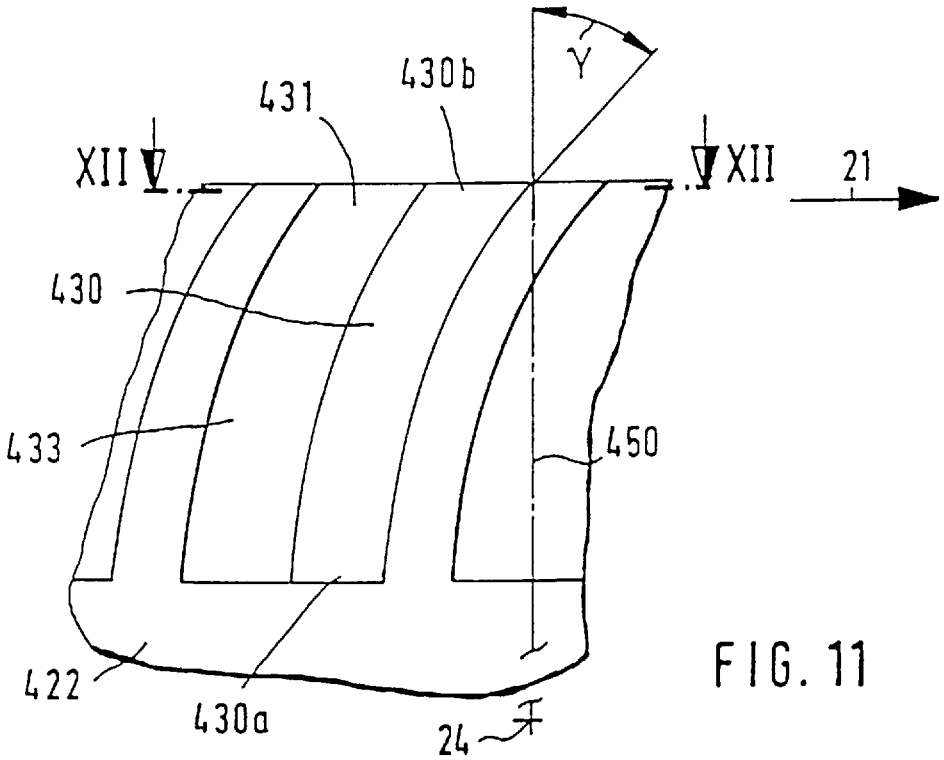
FIG. 11 shows the impeller of the flow pump in a fourth exemplary embodiment, in a side view in the direction of its rotary axis.
Figure 12:
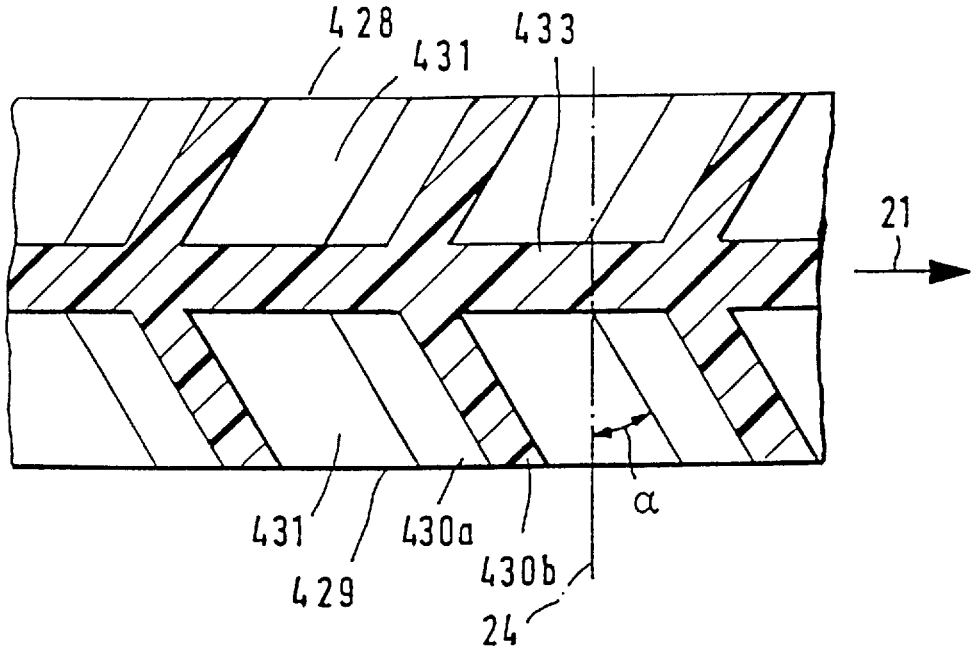
FIG. 12 shows the impeller in a section taken along the line XII—XII of FIG. 11.

In FIGS. 11 and 12, the impeller 422 of the flow pump 14 is shown in a fourth exemplary embodiment. The flow pump 14 is embodied as a peripheral side channel pump and has a feed channel as shown for the first exemplary embodiment in FIG. 2. The impeller 422, on each of its two axially oriented face ends 428, 429, that is, pointing in the direction of its rotary axis 24, has a ring of vanes 430 disposed in the circumferential direction of the impeller 422 and spaced apart from one another, between each of which are interstices 431. The vanes 430 extend radially of the rotary axis 24 of the impeller 422 from a radially inner end 430*a* to a radially outer end 430*b* on the outer circumference of the impeller 422. In the direction of the rotary axis 24 of the impeller 422, the vanes 430 extend from a rib 433, which divides vane rings of the two face ends 428, 429 from one another approximately in the middle of the axial width of the impeller 422, to the face ends 428, 429 of the impeller 422. The vanes 430 are positioned obliquely, as in the exemplary embodiments described above, in such a way that beginning at the rib 433 that divides the vanes from one another, they lead ahead in the circumferential direction 21 of the impeller 422 toward the respective face end 428, 429 where the vanes 430 terminate. This means that the vanes 430 are not disposed parallel to the rotary axis 24 of the impeller 422 but instead, with the rotary axis 24, form an angle α oriented in the circumferential direction 21 of the impeller 422. The angle α is between 25° and 50° and in particular between 30° and 45°. Preferably, the angle α is about 37°. The angle α is approximately constant over the radial extent of the vanes 430, or in other words between their radially inner ends 430*a* and their radially outer ends 430*b*.

As shown in FIG. 12, the radially outer ends 430*b* of the vanes 430 lead in the circumferential direction 21 of the impeller 433 relative to their radially inner ends 430*a*. The vanes 430 extend in curved fashion in the direction of the rotary axis 24 of the impeller 422 between their radially inner ends 430*a* and their radially outer ends 430*b*, although in another version they may also extend rectilinearly. In the region of their radially inner ends 430*a*, the vanes 430 initially extend approximately radially relative to the rotary axis 24 of the impeller 422, and the curvature, that is, the deviation from the radial arrangement, increases toward their radially outer ends 430*b*. In the region of their radially outer ends 430*b*, the vanes 430 and a line 450 that is radial to the rotary axis 24 of the impeller 422 and is laid through the radially outer ends 430*b* of the vanes 430, form an angle gamma oriented in the circumferential direction 21. The angle gamma is between 30° and 60°, particularly between 40° and 55°. Preferably, the angle gamma is about 45°. The above-described arrangement of the vanes 430 is necessary, since in a peripheral side channel pump, although the fuel to be pumped, as in a side channel pump, enters the interstices 431 in the region of the radially inner ends 430*a* of the vanes 430, now however emerges from them radially outward. The vanes 430, viewed in cross section at right angles to the rotary axis 24 of the impeller 422, in the region of their inner ends disposed on the rib 433, are embodied as curved in the circumferential direction 21 in the same way as on the face ends 428, 429 of the impeller 422.

We claim:

1. A flow pump for feeding fuel from a supply container to an internal combustion engine of a motor vehicle, comprising means forming a pump chamber; an impeller rotatable in said pump chamber about a rotary axis and having two axial end sides, said impeller being provided at least on one of said axial sides with a rim of vanes spaced from one another in a peripheral direction; a ring-shaped feeding passage cooperating with said vanes for feeding fuel, said vanes being inclined relative to said rotary axis when considered in a rotary direction relative said rotary axis, so that they extend forward to one of said axial end sides of said impeller in a rotary direction of said impeller, said vanes forming with said rotary axis of said impeller an angle directed in said rotary direction of said impeller, said vanes having radially inner ends and radially outer ends, said angle increasing from said radially inner ends to said radially outer ends of said vanes.

2. A flow pump as described in claim 1, wherein said angle amounts to between 25° and 70°.

3. A flow pump as described in claim 1, wherein said vanes have radially outer ends and radially inner ends located so that said radially outer ends of said vanes at said one end side of said impeller are located forwardly of said radially inner ends of said vanes in a rotary direction of said impeller.

4. A flow pump as described in claim 3, wherein said vanes at said one end side of said impeller are inclined from said radially inner end relative to an imaginary radial arrangement in said rotary direction by an angle amounting to between 20° and 45°.

5. A flow pump as described in claim 1, wherein said angle of inclination of said vanes relative to the rotary axis of said impeller amounts to substantially between 25° and 50° in a region of said radially inner ends and amounts to substantially between 45° and 70° in a region of said radially outer ends.

6. A flow pump as described in claim 1, wherein said vanes are substantially flat.

7. A flow pump as described in claim 1, wherein said vanes extend in said rotary direction of said impeller from said radially inner ends to said radially outer ends in a curved fashion.

8. A flow pump as described in claim 7, wherein said vanes extend substantially radially relative to said rotary axis of said impeller in a region of said radially inner ends.

9. A flow pump as described in claim 1, and further comprising a closed ring connecting said radially outer ends of said vanes with one another.

10. A flow pump as described in claim 9, wherein said means for forming said pump chamber include a chamber wall which limits said ring-shaped feeding passage in the direction of said rotary axis of said impeller, said feeding passage extending in a radial direction relative to said rotary axis between said radially inner ends and said radially outer ends of said impeller.

11. A flow pump as described in claim 1, wherein said impeller has another rim of vanes provided on the other axial end side, said feeding passage extending at said end sides of said impeller and also covering an outer periphery of said impeller.

12. A flow pump as described in claim 11, wherein said vanes in a cross-section perpendicular to said rotary axis when considered in a region of a radially outer edge of said vanes are inclined in said rotary direction of said impeller relative to a radial direction to said rotary axis by a further angle amounting to substantially between 30° and 60°.

* * * * *